US011801429B2

(12) United States Patent
Brown, Jr. et al.

(10) Patent No.: US 11,801,429 B2
(45) Date of Patent: Oct. 31, 2023

(54) GOLF SHAFT WITH NON-UNIFORM BASE PAINT AND METHOD OF APPLYING THE SAME

(71) Applicant: TRUE TEMPER SPORTS, INC., Memphis, TN (US)

(72) Inventors: Donald Collins Brown, Jr., San Diego, CA (US); Jesus Arturo Banuelos, San Diego, CA (US); Armando Herrera, Chula Vista, CA (US)

(73) Assignee: TRUE TEMPER SPORTS, INC., Memphis, TN (US)

( * ) Notice: Subject to any disclaimer, the term of this patent is extended or adjusted under 35 U.S.C. 154(b) by 0 days.

(21) Appl. No.: 15/733,995

(22) PCT Filed: Jun. 5, 2019

(86) PCT No.: PCT/US2019/035515

§ 371 (c)(1),
(2) Date: Dec. 1, 2020

(87) PCT Pub. No.: WO2019/236666

PCT Pub. Date: Dec. 12, 2019

(65) Prior Publication Data

US 2021/0228951 A1 Jul. 29, 2021

Related U.S. Application Data

(60) Provisional application No. 62/681,382, filed on Jun. 6, 2018.

(51) Int. Cl.
*A63B 53/10* (2015.01)
*A63B 53/12* (2015.01)
(Continued)

(52) U.S. Cl.
CPC ..... *A63B 53/10* (2013.01); *A63B 53/12* (2013.01); *A63B 60/006* (2020.08);
(Continued)

(58) Field of Classification Search
CPC ..... A63B 53/00; A63B 2102/32; A63B 53/10; A63B 53/12; Y10S 40/915;
(Continued)

(56) References Cited

U.S. PATENT DOCUMENTS 2,331,983 A * 10/1943 Kaiser, Jr. ..... B05C 3/12 118/404
4,046,225 A 9/1977 Shenk
(Continued)

OTHER PUBLICATIONS

International Search Report and Written Opinion of the ISA issued in PCT Application No. PCT/US2019/035515, dated Sep. 19, 2019; ISA/KR.

*Primary Examiner* — James M Mellott

(57) ABSTRACT

A method for applying base paint non-uniformly to a golf shaft includes: inserting a portion of a golf shaft lengthwise through an aperture in a paint applicator, the paint applicator having a first surface and a second surface opposite the first surface, where one of (a) the aperture is non-circular and (b) the aperture includes a plurality of slits formed circumferentially around the aperture; actuating a painting apparatus, thereby causing the base paint to contact the golf shaft and the second surface of the paint applicator; and pulling the golf shaft lengthwise through the aperture in the paint applicator, thereby non-uniformly applying the base paint lengthwise along the portion of the golf shaft.

21 Claims, 8 Drawing Sheets

(51) Int. Cl.

| | |
|---|---|
| ***A63B 102/32*** | (2015.01) |
| ***A63B 60/00*** | (2015.01) |
| ***B05D 1/26*** | (2006.01) |
| ***B05D 5/06*** | (2006.01) |

(52) U.S. Cl.
CPC ..... *A63B 2102/32* (2015.10); *A63B 2209/00* (2013.01); *B05D 1/265* (2013.01); *B05D 5/06* (2013.01)

(58) Field of Classification Search
CPC ..... B05D 2254/00; B05D 2254/02; B05D 2254/04; B05D 2254/06; B05D 2256/00; B05D 5/00
See application file for complete search history.

(56) References Cited

U.S. PATENT DOCUMENTS

| | | | | |
|---|---|---|---|---|
| 2003/0003239 | A1* | 1/2003 | Grubbs | B05D 1/18 427/430.1 |
| 2006/0030663 | A1* | 2/2006 | Andre | A63B 37/0031 524/588 |
| 2009/0298608 | A1* | 12/2009 | Yatsuda | A63B 60/00 473/316 |
| 2011/0118049 | A1 | 5/2011 | Simpson et al. | |
| 2011/0118050 | A1 | 5/2011 | Brown, Jr. et al. | |
| 2014/0272164 | A1* | 9/2014 | McEvoy | B05C 5/0241 427/429 |

* cited by examiner

GOLF SHAFT WITH NON-UNIFORM BASE PAINT AND METHOD OF APPLYING THE SAME

CROSS-REFERENCE TO RELATED APPLICATIONS

This application is a U.S. National Phase Application under 35 U.S.C. 371 of International Application No. PCT/US2019/035515, filed on Jun. 5, 2019, which claims the benefit of U.S. Provisional Application No. 62/681,382, filed on Jun. 6, 2018. The entire disclosures of the applications referenced above are incorporated herein by reference.

FIELD

The present disclosure relates to shafts of golf clubs and more particularly to golf club shafts with non-uniform base paints and methods of applying non-uniform base paint to golf club shafts.

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

Golf shafts may have base paint that is a solid color.

SUMMARY

In a feature, a method for applying base paint non-uniformly to a golf shaft includes: inserting a portion of a golf shaft lengthwise through a non-circular aperture in a paint applicator, the paint applicator having a first surface and a second surface opposite the first surface; actuating a painting apparatus, thereby causing the base paint to contact the golf shaft and the second surface of the paint applicator; and pulling the golf shaft lengthwise through the non-circular aperture in the paint applicator, thereby non-uniformly applying the base paint lengthwise along the portion of the golf shaft.

In further features, the non-circular aperture includes a square aperture.

In further features, the non-circular aperture includes a triangular aperture.

In further features, the pulling comprises varying a speed at which the golf shaft is pulled through the non-circular opening.

In further features, the pulling comprises maintaining approximately a constant speed of the pulling through the non-circular opening.

In further features the method further includes, during the pulling of the golf shaft, rotating the golf shaft.

In further features the method further includes, during the pulling of the golf shaft, not rotating the golf shaft.

In further features the method further includes: drying the base paint; inserting a second portion of golf shaft lengthwise through the non-circular aperture in the paint applicator; actuating the painting apparatus, thereby causing the base paint to contact the golf shaft and the second surface of the paint applicator; and pulling the golf shaft lengthwise through the non-circular aperture in the paint applicator, thereby non-uniformly applying a second coat of the base paint lengthwise along the second portion of the golf shaft.

In further features the method further includes: drying the base paint; inserting a second portion of golf shaft lengthwise through a second non-circular aperture in a second paint applicator, the second paint applicator having a third surface and a fourth surface opposite the third surface; actuating a second painting apparatus, thereby causing a second base paint to contact the golf shaft and the fourth surface of the second paint applicator; and pulling the golf shaft lengthwise through the second non-circular aperture in the second paint applicator, thereby non-uniformly applying a second coat of the second base paint lengthwise along the second portion of the golf shaft.

In further features the method further includes: drying the base paint; and applying to the portion of the golf shaft a coat of one of a translucent paint and a transparent paint.

In further features, the paint applicator includes a rubber paint applicator.

In further features, the paint applicator includes a sponge.

In a feature, a method for applying base paint non-uniformly to a golf shaft includes: inserting a portion of a golf shaft lengthwise through a circular aperture in a paint applicator, the paint applicator having a first surface and a second surface opposite the first surface, and the circular aperture including slits formed circumferentially around the circular aperture; actuating a painting apparatus, thereby causing the base paint to contact the golf shaft and the second surface of the paint applicator; and pulling the golf shaft lengthwise through the circular aperture in the paint applicator, thereby non-uniformly applying the base paint lengthwise along the portion of the golf shaft.

In further features, the slits are located equidistantly around the circumference of the circular aperture.

In further features, the slits are located non-equidistantly around the circumference of the circular aperture.

In further features, the pulling comprises varying a speed at which the golf shaft is pulled through the non-circular opening.

In further features, the pulling comprises maintaining approximately a constant speed of the pulling through the non-circular opening.

In further features the method further includes, during the pulling of the golf shaft, rotating the golf shaft.

In further features the method further includes, during the pulling of the golf shaft, not rotating the golf shaft.

In further features the method further includes: drying the base paint; inserting a second portion of golf shaft lengthwise through the circular aperture in the paint applicator; actuating the painting apparatus, thereby causing the base paint to contact the golf shaft and the second surface of the paint applicator; and pulling the golf shaft lengthwise through the circular aperture in the paint applicator, thereby non-uniformly applying a second coat of the base paint lengthwise along the second portion of the golf shaft.

In further features the method further includes: drying the base paint; inserting a second portion of golf shaft lengthwise through a second circular aperture in a second paint applicator, the second paint applicator having a third surface and a fourth surface opposite the third surface; actuating a second painting apparatus, thereby causing a second base paint to contact the golf shaft and the fourth surface of the second paint applicator; and pulling the golf shaft lengthwise through the second circular aperture in the second paint applicator, thereby non-uniformly applying a second coat of the second base paint lengthwise along the second portion of the golf shaft.

In further features the method further includes: drying the base paint; and applying to the portion of the golf shaft a coat of one of a translucent paint and a transparent paint.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

The ability to create non uniform colors or patterns on golf shafts provides a cosmetic that will help differentiate a product in the market place. The present disclosure describes golf shafts (e.g., graphite, steel, or hybrid graphite and steel) with non-uniform base paint and methods of manufacturing the same.

An example method includes creating streaks in a base paint (thereby creating streaks of different colors) through the use of a (e.g., rubber) paint applicator (e.g., a squeegee) with a non-circular aperture or with a circular aperture with notches or slits surrounding the circular aperture. Golf shafts are pulled through the apertures to apply paint to the golf shafts. Paint applicators with a circular aperture may apply a consistent/uniform film of base paint along the length of a golf shaft. A paint applicator with a non-circular aperture or with a circular aperture with notches, however, applies different amounts of paint at different locations on a golf shaft, thus creating the appearance of streaks on the golf shaft.

Golf shafts can be axially rotated during the pulling through the aperture of the paint applicator to create a variety of different shapes of streaks. For example, golf shafts can be axially rotated to create sine wave shaped streaks, triangular wave shaped streaks, square wave shaped streaks, helix shaped streaks, and streaks of other shapes.

The speed at which a golf shaft is pulled through the aperture of the paint applicator and the rotation of the golf shaft determine the shape of the streaks created on the golf club shaft.

In various implementations, multiple layers of paint can be applied to create a variety of different appearances. Once a pattern has been created in base paint on a golf shaft, a coat of translucent or transparent paint can be applied, for example, to increase a depth of color.

Figure 1:
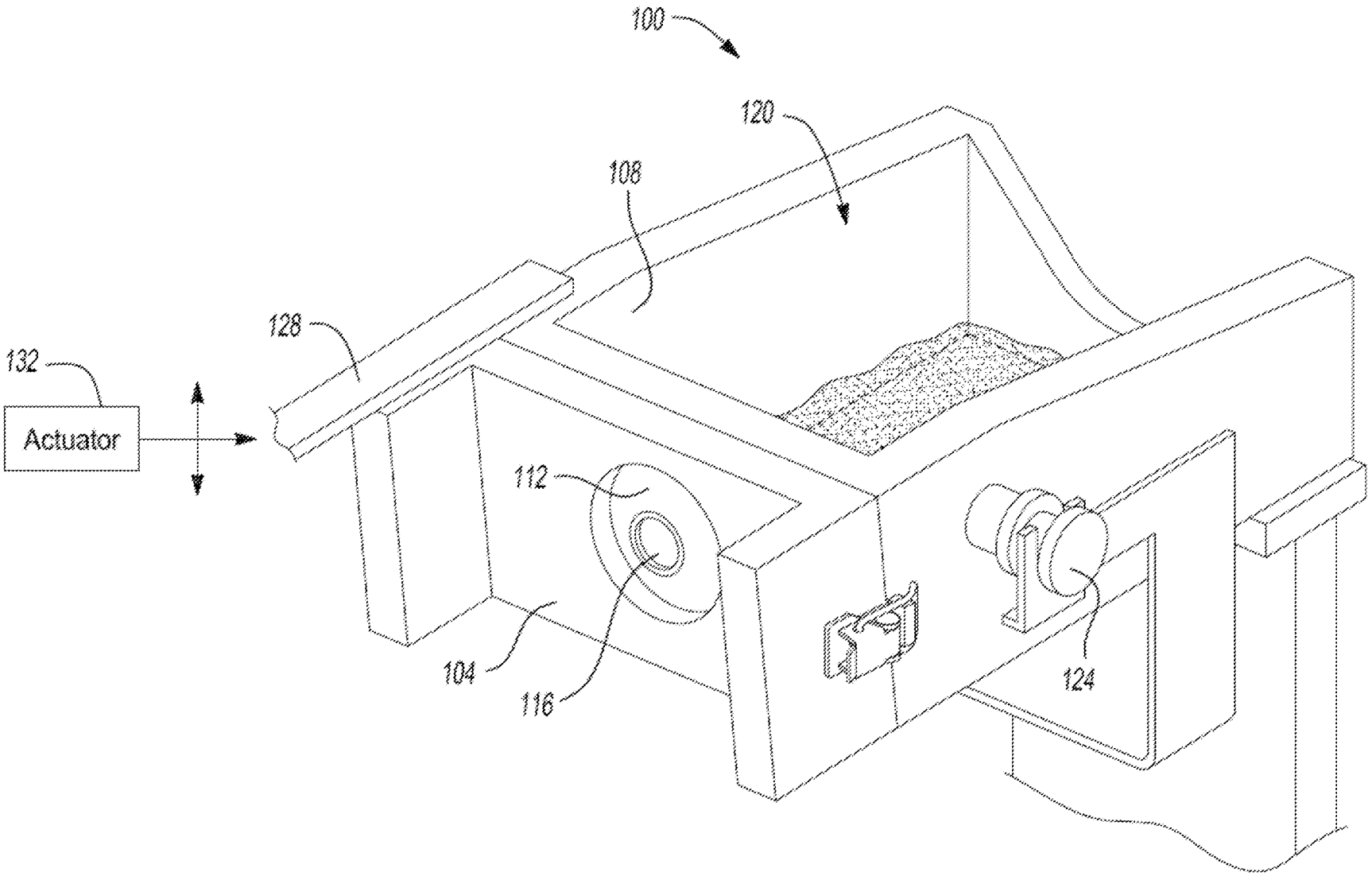
FIG. 1 includes an example illustration of a base paint application system including a shaft painting apparatus.

FIG. 1 includes an example illustration of a base paint application system including a shaft painting apparatus 100. The shaft painting apparatus 100 is used to apply one or more layers of base paint to golf club shafts, such as graphite golf club shafts, steel golf club shafts, and hybrid steel and graphite golf club shafts.

The shaft painting apparatus 100 may include a first portion 104 and a second portion 108. A paint applicator 112 (e.g., a squeegee or a sponge) is sandwiched between the first portion 104 and the second portion 108 and includes an aperture 116 within apertures in the first and second portions 104 and 108. The aperture 116 may be circular and have one or more notches located radially around the outer edge of the circular aperture. Alternatively, the aperture 116 may be non-circular, such as triangular, square, pentagonal, hexagonal, heptagonal, octagonal, etc.

Figure 2:
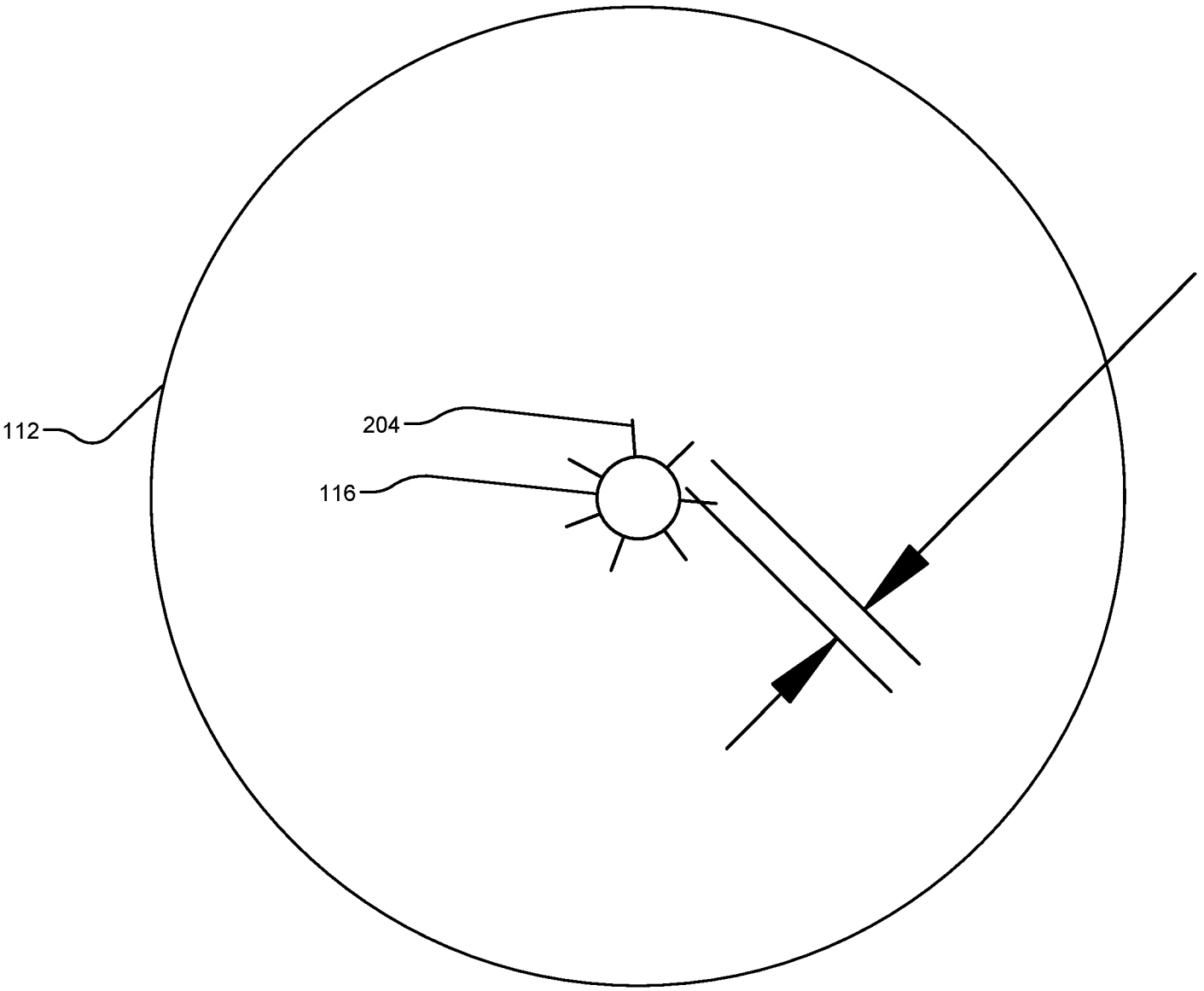
FIG. 2 includes an example illustration of a paint applicator including a circular aperture with notches.

FIG. 2 includes an example illustration of the paint applicator 112 including a circular aperture with notches 204. While the example of 7 notches is provided, one or more notches may be implemented. The radial spacing between the notches 204 may be the same, different, or a combination of the same and different spacing. The paint applicator 112 may be made of, for example, rubber or another suitable pliable material. The diameter of the aperture 116 may be smaller than a smallest diameter of golf shafts to be painted using the shaft painting apparatus 100. Golf shafts may be tapered or have different diameters from one end to the other.

Figure 3:
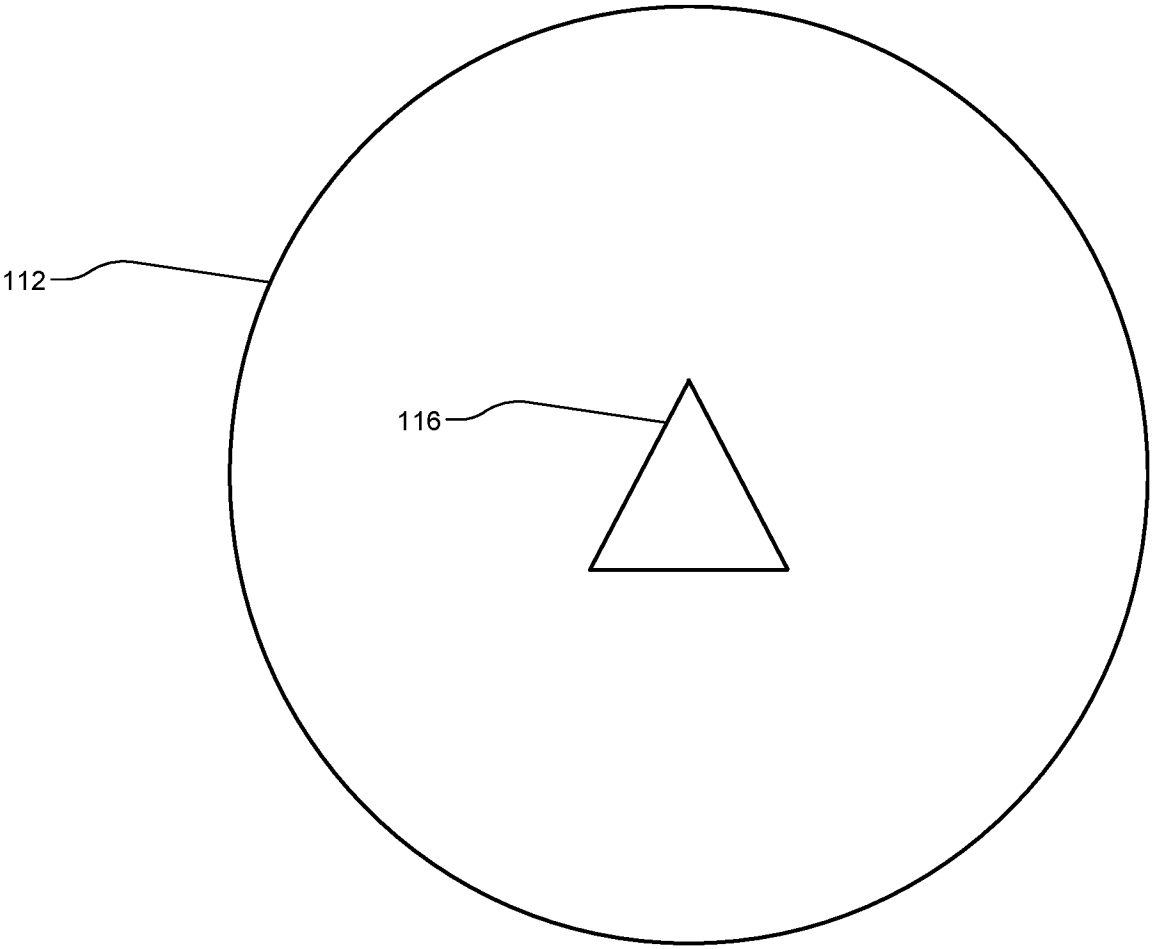
FIG. 3 includes an example illustration of a paint applicator including a triangular aperture.
Figure 4:
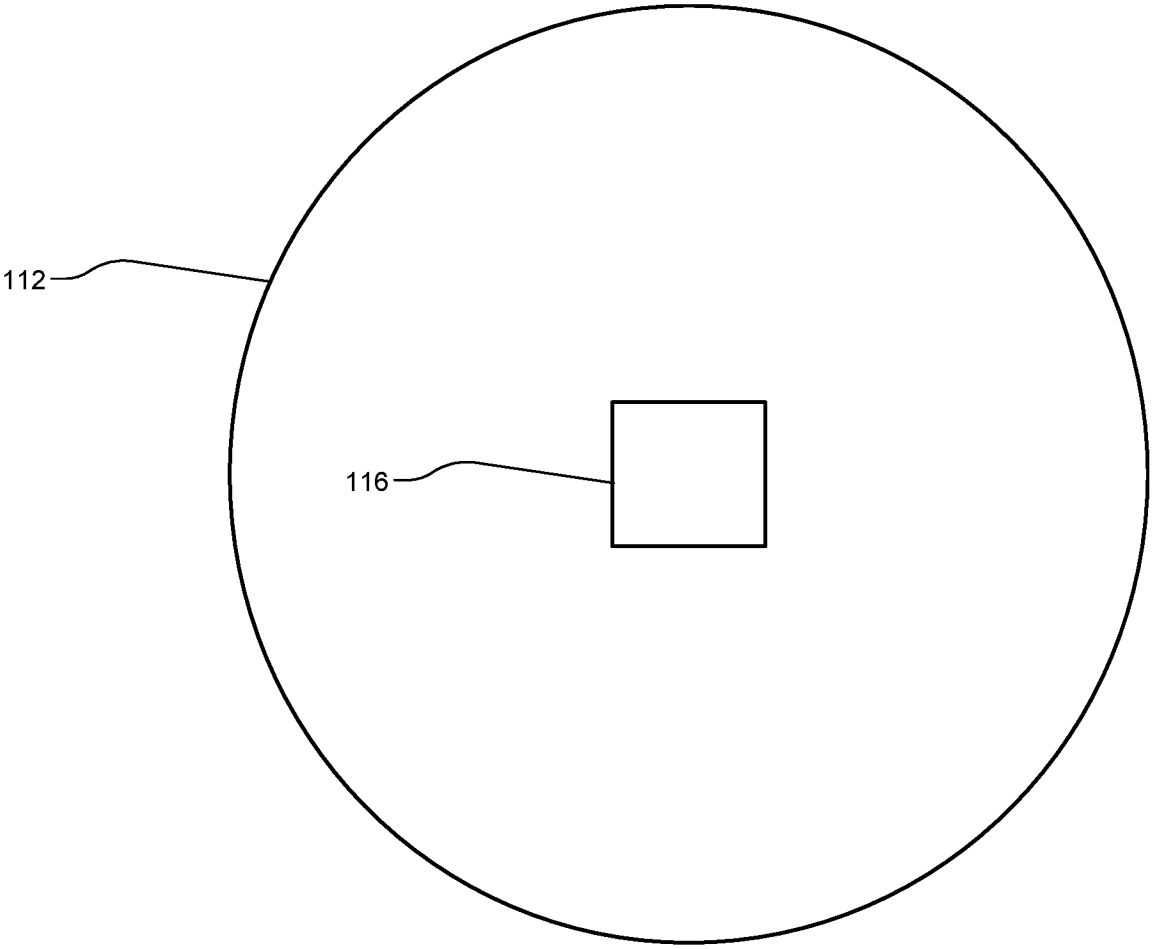
FIG. 4 includes an example illustration of a paint applicator including a square aperture.

FIG. 3 includes an example illustration of the paint applicator 112 including a triangular aperture. FIG. 4 includes an example illustration of the paint applicator 112 including a square aperture. Non-circular apertures may or may not include one or more notches. While examples including triangular and square apertures are shown, the present application is also applicable to other non-circular shaped apertures.

Referring back to FIG. 1, base paint is filled into a recess 120 in the second portion 108. The shaft painting apparatus 100 may be rotatable about an axis 124. An actuator arm 128 may be mounted to the shaft painting apparatus 100 and may be moved vertically upwardly and downwardly to rotate the shaft painting apparatus 100 about the axis 124.

When the actuator arm 128 is lowered vertically, base paint within the recess 120 may flow toward the paint applicator 112. When the actuator arm 128 is raised vertically, base paint within the recess 120 may flow away from the paint applicator 112. A stop may be implemented to provide an upper most position for the actuator arm 128 (a rest position of the shaft painting apparatus 100) where the base paint flows away from the paint applicator 112.

An actuator 132 actuates the actuator arm 128 upwardly or downwardly. The actuator 132 may be, for example, a human or a robot.

Figure 5:
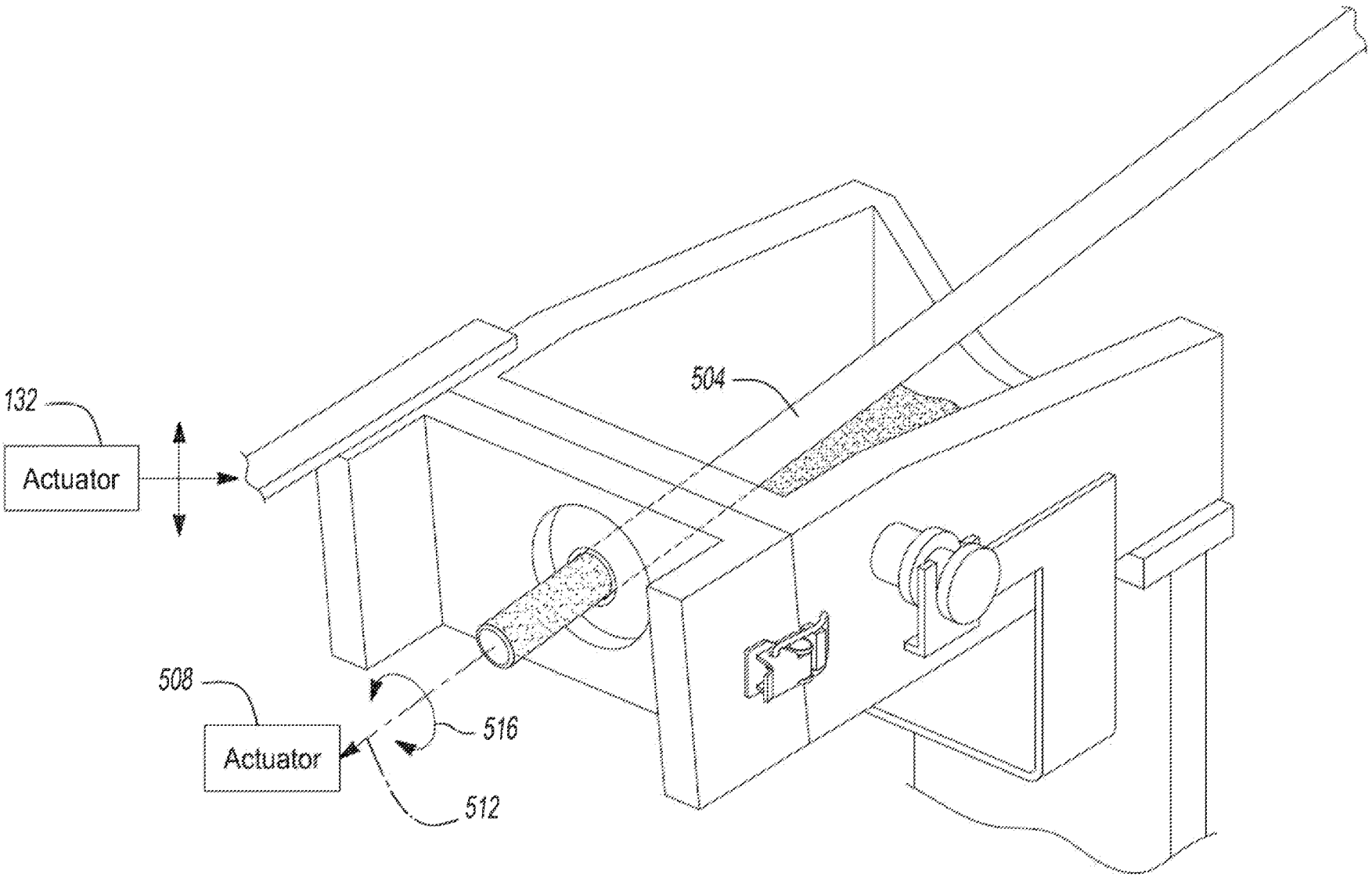
FIG. 5 includes an example illustration of a golf shaft inserted through an aperture of a paint applicator.

FIG. 5 includes an example illustration of a golf shaft 504 inserted through the aperture 116 of the paint applicator 112. For example, the smaller diameter end of the golf shaft 504 may be inserted through the aperture 116 in the paint applicator 112. While the example of a graphite golf shaft is provided, the present application is also applicable to steel golf shafts, hybrid steel and graphite golf shafts, and other types of golf shafts. The golf shaft 504 may be inserted through the aperture 116 when the shaft painting apparatus 100 is in the rest position.

Figure 6:
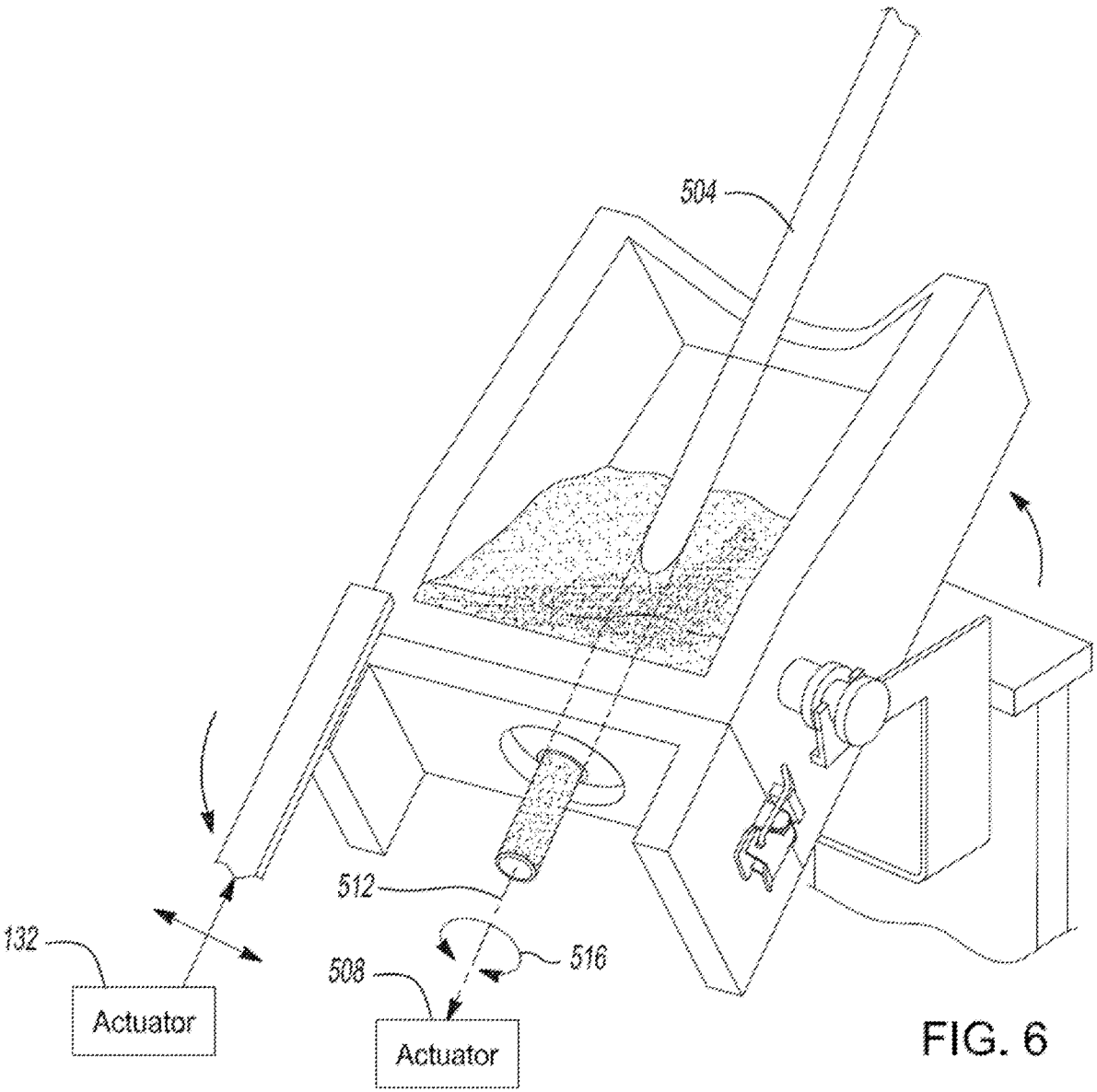
FIG. 6 includes an example illustration of an actuator arm being lowered relative to its position in the rest position.

Once the golf shaft 504 is inserted through the aperture 116, the actuator 132 lowers the actuator arm 128, thus causing the base paint within the recess 120 to flow toward the paint applicator 112. FIG. 6 includes an example illustration of the actuator arm 128 being lowered (relative to its position in the rest position). As shown, the base paint within the recess 120 flows (by gravitational force) toward the paint applicator 112.

While the base paint is present on the paint applicator 112, an actuator 508 axially pulls the golf shaft 504 through the aperture 116. The axial pulling of the golf shaft 504 is illustrated by arrow 512. The non-circular shape of the aperture 116 and/or the notches 204 create streaks in the base paint applied to the golf shaft 504. More specifically, the non-circular shape of the aperture 116 and/or the notches 204 create locations where less or none of the base paint is applied to the golf shaft 504 and locations where more base paint is applied to the golf shaft 504. The different thicknesses of base paint create the appearance of streaks in the base paint.

The actuator 508 may be a human or a robot. The actuator 508 may be the same as the actuator 132 in some instances, such as when a human applies the base paint to golf shafts.

Figure 7:
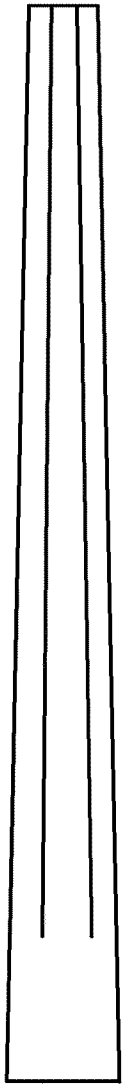
FIG. 7 includes an example perspective view of a golf shaft having linear streaks.

The actuator 508 may axially pull the golf shaft 504 through the aperture 116 to create linear streaks down the length of the golf shaft 504. FIG. 7 includes an example perspective view of a golf shaft having linear streaks. The linear streaks may be created at various locations around the circumference of the golf shaft.

Figure 10:
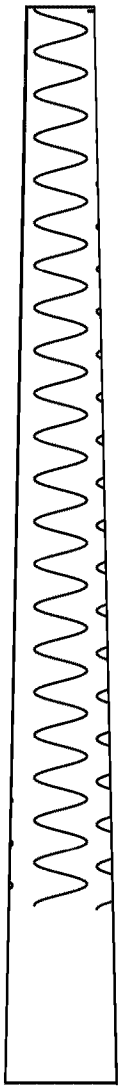
FIGS. 8-10 include an example perspective views of a golf shaft having non-linear streaks.
Figure 9:
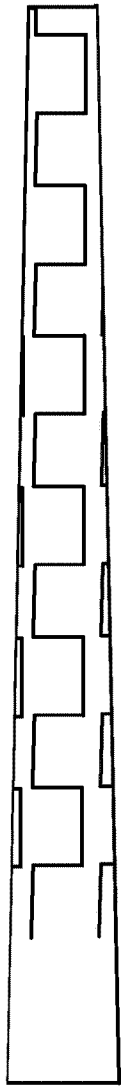
Figure 8:
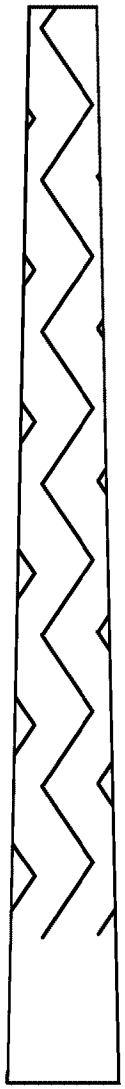

The actuator 508 may also rotates the golf shaft 504 about the axis of the golf shaft 504 concurrently with pulling the golf shaft 504 through the aperture 116 or alternately with pulling the golf shaft 504 through the aperture. The rotation of the golf shaft 504 is illustrated by arrow 516. FIGS. 8-10 include an example perspective views of a golf shaft having non-linear streaks. The rotation and the pulling dictate the pattern of the streaks created in the base paint.

As stated above, one or more coats of base paint may be applied to a golf shaft. Two or more coats of base paint may be applied, for example, to create a linen or basket weave design of streaks in the base paint. Once the base paint has been applied (and is dry), one or more coats of transparent or translucent paint can be applied over the base paint. Transparent or translucent paint may increase a depth of the paint on a golf shaft.

While the example of periodic patterns are illustrated in FIGS. 8-10, the patterns created in the streaks may be periodic or non-periodic. Additionally, the amplitudes may be the same or variable.

Figure 11:
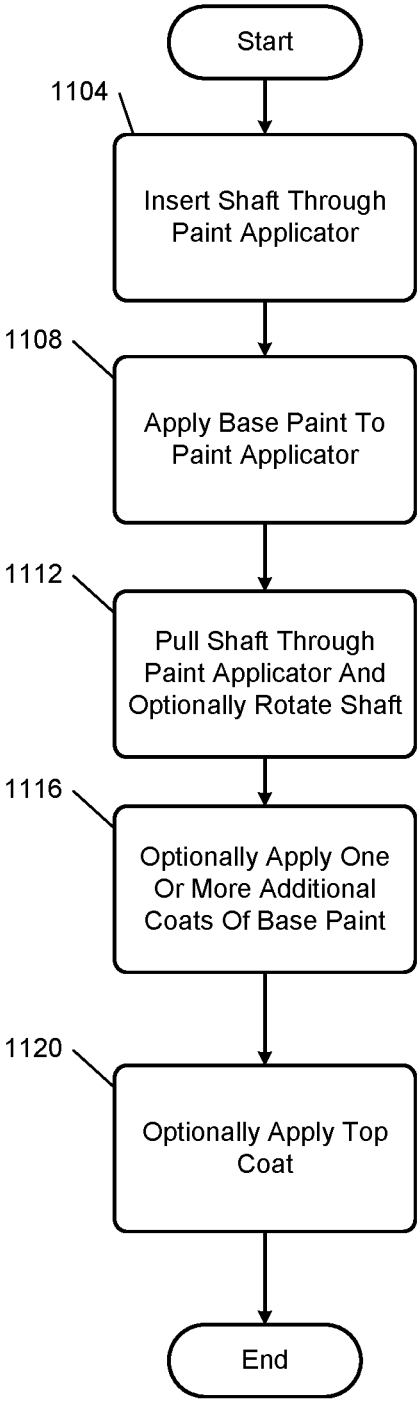
FIG. 11 includes a flowchart depicting an example method of painting a golf (club) shaft.

FIG. 11 includes a flowchart depicting an example method of painting a golf (club) shaft. Control begins with 1104 where the actuator 508 inserts the golf shaft through the aperture 116 in the paint applicator 112. The golf shaft may be inserted, for example, smaller diameter end first. A portion of the golf shaft at the larger diameter end of the golf shaft may extend out from the paint applicator 112 and not be painted. A grip is later applied at the larger diameter end of the golf shaft.

At 1108, the actuator 132 applies base paint to the paint applicator 112. For example, the actuator 132 may lower the actuator arm 128 and cause base paint within the recess 120 to flow to the paint applicator 112. At 1112, the actuator 508 pulls the golf shaft through the aperture in the paint applicator 112. The actuator 508 may pull the golf shaft at approximately a constant speed or at varying speeds. Approximately may mean within +/−10%. This applies a coat of the base paint to the exterior of the golf shaft. The non-circular shape of the aperture 116 and/or the notches in the aperture create streaks in the base paint. Optionally at 1112 the actuator 508 may rotate the golf shaft to create non-linear streaks in the base paint. Alternatively, the actuator 508 may not rotate the golf shaft.

At 1116, optionally one or more additional coats of base paint may be applied to the golf shaft. At 1120, optionally one or more coats of transparent or translucent paint may be applied to the golf shaft as a top coat. Once the paint has dried on the golf shaft, a golf club head can be attached to the smaller diameter end of the golf shaft, and a grip can be attached to the larger diameter end of the golf shaft.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. A method for applying base paint non-uniformly to a golf shaft, the method comprising:

inserting a portion of a golf shaft lengthwise through a non-circular aperture in a paint applicator, the paint applicator having a first surface and a second surface opposite the first surface;

actuating a painting apparatus, thereby causing the base paint to contact the golf shaft and the second surface of the paint applicator; and pulling the golf shaft lengthwise through the non-circular aperture in the paint applicator, thereby non-uniformly applying the base paint lengthwise along the portion of the golf shaft, wherein the paint applicator includes a sponge.

2. The method of claim 1 wherein the non-circular aperture includes a square aperture.

3. The method of claim 1 wherein the non-circular aperture includes a triangular aperture.

4. The method of claim 1 wherein the puffing comprises varying a speed at which the golf shaft is pulled through the non-circular opening.

5. The method of claim 1 wherein the pulling comprises maintaining approximately a constant speed of the puffing through the non-circular opening.

6. The method of claim 1 further comprising, during the pulling of the golf shaft, rotating the golf shaft.

7. The method of claim 1 further comprising, during the pulling of the golf shaft, not rotating the golf shaft.

8. The method of claim 1 further comprising:

drying the base paint;

inserting a second portion of golf shaft lengthwise through the non-circular aperture in the paint applicator;

actuating the painting apparatus, thereby causing the base paint to contact the golf shaft and the second surface of the paint applicator; and pulling the golf shaft lengthwise through the non-circular aperture in the paint applicator, thereby non-uniformly applying a second coat of the base paint lengthwise along the second portion of the golf shaft.

9. The method of claim 1 further comprising:

drying the base paint;

inserting a second portion of golf shaft lengthwise through a second non-circular aperture in a second paint applicator, the second paint applicator having a third surface and a fourth surface opposite the third surface;

actuating a second painting apparatus, thereby causing a second base paint to contact the golf shaft and the fourth surface of the second paint applicator; and pulling the golf shaft lengthwise through the second non-circular aperture in the second paint applicator, thereby non-uniformly applying a second coat of the second base paint lengthwise along the second portion of the golf shaft.

10. The method of claim 1 further comprising:

drying the base paint; and applying to the portion of the golf shaft a coat of one of a translucent paint and a transparent paint.

11. A method for applying base paint non-uniformly to a golf shaft, the method comprising:

inserting a portion of a golf shaft lengthwise through a circular aperture in a paint applicator, the paint applicator having a first surface and a second surface opposite the first surface, and the circular aperture including slits formed circumferentially around the circular aperture and extending radially outwardly away from the circular aperture;

actuating a painting apparatus, thereby causing the base paint to contact the golf shaft and the second surface of the paint applicator; and pulling the golf shaft lengthwise through the circular aperture in the paint applicator, thereby non-uniformly applying the base paint lengthwise along the portion of the golf shaft.

12. The method of claim 11 wherein the slits are located equidistantly around the circumference of the circular aperture.

13. The method of claim 11 wherein the slits are located non-equidistantly around the circumference of the circular aperture.

14. The method of claim 11 wherein the pulling comprises varying a speed at which the golf shaft is pulled through the circular opening.

15. The method of claim 11 wherein the pulling comprises maintaining approximately a constant speed of the pulling through the circular opening.

16. The method of claim 11 further comprising, during the puffing of the golf shaft, rotating the golf shaft.

17. The method of claim 11 further comprising, during the pulling of the golf shaft, not rotating the golf shaft.

18. The method of claim 11 further comprising:

drying the base paint;

inserting a second portion of golf shaft lengthwise through the circular aperture in the paint applicator;

actuating the painting apparatus, thereby causing the base paint to contact the golf shaft and the second surface of the paint applicator; and pulling the golf shaft lengthwise through the circular aperture in the paint applicator, thereby non-uniformly applying a second coat of the base paint lengthwise along the second portion of the golf shaft.

19. The method of claim 11 further comprising:

drying the base paint;

inserting a second portion of golf shaft lengthwise through a second circular aperture in a second paint applicator, the second paint applicator having a third surface and a fourth surface opposite the third surface;

actuating a second painting apparatus, thereby causing a second base paint to contact the golf shaft and the fourth surface of the second paint applicator; and puffing the golf shaft lengthwise through the second circular aperture in the second paint applicator, thereby non-uniformly applying a second coat of the second base paint lengthwise along the second portion of the golf shaft.

20. The method of claim 11 further comprising:

drying the base paint; and applying to the portion of the golf shaft a coat of one of a translucent paint and a transparent paint.

21. A method for applying base paint non-uniformly to a golf shaft, the method comprising:

inserting a portion of a golf shaft lengthwise through a non-circular aperture in a paint applicator, the paint applicator having a first surface and a second surface opposite the first surface;

actuating a painting apparatus, thereby causing the base paint to contact the golf shaft and the second surface of the paint applicator;

pulling the golf shaft lengthwise through the non-circular aperture in the paint applicator, thereby non-uniformly applying the base paint lengthwise along the portion of the golf shaft, wherein the pulling comprises varying a speed at which the golf shaft is pulled through the non-circular opening; and during the pulling of the golf shaft, rotating the golf shaft.

* * * * *